US005979273A

United States Patent [19]

Walton

[11] Patent Number: 5,979,273

[45] Date of Patent: Nov. 9, 1999

[54] TORQUE WRENCH

[75] Inventor: John Nigel Walton, Morpeth, United Kingdom

[73] Assignee: Hedley Purvis Limited, Morpeth, United Kingdom

[21] Appl. No.: 08/913,602

[22] PCT Filed: Mar. 18, 1996

[86] PCT No.: PCT/GB96/00637

§ 371 Date: Sep. 18, 1997

§ 102(e) Date: Sep. 18, 1997

[87] PCT Pub. No.: WO96/29181

PCT Pub. Date: Sep. 26, 1996

[30] Foreign Application Priority Data

Mar. 20, 1995 [GB] United Kingdom ..... 9505545

[51] Int. Cl.[6] ..... B25B 13/46

[52] U.S. Cl. ..... 81/57.39; 81/63.1

[58] Field of Search ..... 81/57.39, 57.19, 81/57.32, 57.22, 57.44, 63.1, 60–62

*Primary Examiner*—D. S. Meislin

*Attorney, Agent, or Firm*—Larson & Taylor

[57] ABSTRACT

This invention relates to torque wrenches, and more particularly to torque wrenches that are bi-directional in operation. A torque wrench comprises a housing in which is mounted a rotatable ratchet mechanism, a first lever and a first drive for applying a driving force to the first lever to pivot the first lever reciprocatingly between a rest position and a fully displaced position. Further included is a second lever and second drive for applying a driving force to the second lever to pivot the second lever reciprocatingly between a rest position and a fully displaced position.

5 Claims, 3 Drawing Sheets

TORQUE WRENCH

TECHNICAL FIELD

This invention relates to torque wrenches, and more particularly to torque wrenches that are bi-directional in operation.

BACKGROUND ART

Torque wrenches, and in particular hydraulic torque wrenches, are well established for use in tightening bolted joints. Such wrenches usually include a hydraulically-operated ram reciprocation of the piston of which causes rotation of an associated crank lever. A ratchet mechanism incorporating means for co-operation with the nut or bolt to be tightened is, in turn, rotated by the lever through drive means reacting between the lever and the ratchet mechanism whereby the nut or bolt is itself rotated.

The application of such a torque wrench to the nut or bolt provides for rotation of the nut or bolt in one direction.

In order to rotate the nut or bolt in the opposite direction, the wrench must be removed from the nut or bolt, turned over, and re-applied to the nut or bolt.

There are situations, for example in the subsea and nuclear industries, where torque wrenches have to be operated remotely, and, in such circumstances, it is not feasible to remove, turn over and reapply the torque wrench to enable the nuts or bolts to be rotated in different directions.

Additionally, torque wrenches are finding uses in many industries as valve actuators where rotation of the valve spindle in both directions must be readily available.

It has therefore been proposed, for example as disclosed in U.S. Pat. No. 2,729,997, to provide torque wrenches incorporating bi-directional mechanisms whereby rotation in both directions can be achieved without removing the wrench from the component to be rotated.

Such bi-directional torque wrenches commonly incorporate a pair of drive shoes each reacting between the crank lever and the ratchet mechanism, one shoe associated with clockwise rotation of the ratchet mechanism and the other shoe associated with anticlockwise rotation of said mechanism.

More particularly, the two drive shoes are interconnected with one another, each shoe being movable between an operative drive position engaging with the ratchet mechanism and an inoperative position disengaged from said mechanism. The interconnection of the two shoes is such that, when one of the drive shoes is in its operative drive position, the other drive shoe is completely disengaged from the ratchet mechanism.

A switching mechanism, which may be manually operated or powered, is provided to alter the relative positions of the drive shoes to achieve either clockwise or anticlockwise rotation. Failure to disengage one of the drive shoes when engaging the other shoe will result in the wrench locking up and preventing rotation of the ratchet mechanism in either direction—the drive shoes will work against one another when both engage the ratchet mechanism.

In the aforementioned subsea and nuclear industries, it is clearly not possible to switch the torque wrench manually, and a remote control arrangement is therefore required.

However, remote switching mechanisms are both expensive and complex to install. For example the wrench may incorporate a hydraulically-operated ram to effect the switching which must be provided with a receiver and a power supply actuated by a remote signal.

Such additional equipment clearly increases the risk of a failure occurring, while the remote nature of the switching operation leads to questions as to whether or not switching has in fact occurred. A sensor could be provided to detect the appropriate movement, but this adds still further to the cost.

DISCLOSURE OF THE INVENTION

It would be desirable to be able to provide a torque wrench capable of providing both clockwise and anticlockwise rotation of a component without the necessity of removing the wrench from the component and without the requirement for a manually-operated or powered switching mechanism within the wrench.

According to the present invention there is provided a torque wrench comprising a housing in which is mounted a rotatable ratchet mechanism adapted to cooperate with a component to be rotated by the wrench, a first drive lever extending radially of said ratchet mechanism and pivotal about one end thereof coaxial with the ratchet mechanism, first lever drive means for applying a driving force to the other end of the first lever to pivot said first lever about the one end thereof reciprocatingly between a rest position and a fully displaced position, first drive means reacting between the first lever and the ratchet mechanism whereby, on movement of the first lever from the rest position towards the fully displaced position, the ratchet mechanism is rotated in one direction, a second drive lever extending radially of said ratchet mechanism and pivotal about one end thereof coaxial with the ratchet mechanism, second lever drive means for applying a driving force to the other end of the second lever to pivot said second lever about the one end thereof reciprocatingly between a rest position and a fully displaced position, and second drive means reacting between the second lever and the ratchet mechanism whereby, on movement of the second lever from the rest position towards the fully displaced position, the ratchet mechanism is rotated in the other direction, the wrench further comprising control means reacting between the housing and the first and second drive means such that, with a lever in its rest position, the associated drive means is disengaged from the ratchet mechanism, and such that, on movement of a drive lever from its rest position towards its fully displaced position, the associated drive means are brought into engagement with the ratchet mechanism while the other drive lever is held in its rest position with its associated drive means disengaged from the ratchet mechanism.

It will thus be appreciated that, with such an arrangement, rotation of the component to be tightened or loosened can be achieved in either direction by appropriate pivoting movement of the associated drive lever, there being no need to actuate any switching means, disengagement of the non-active drive means occurring automatically when in its rest position by virtue of said control means.

In one embodiment of the invention, each drive means is mounted on a lever arm pivotal on the associated drive lever, abutment means being provided on the housing whereby, with the drive lever in its rest position, the lever arm engages the associated abutment means to pivot the drive means out of engagement with the ratchet mechanism, and, on movement of the drive lever to a displaced position, the lever arm disengages from said abutment means whereby the drive means move into driving engagement with the ratchet mechanism.

In an alternative embodiment of the invention, the torque wrench includes, for each drive lever, a lever arm pivotal on the housing, one end of the lever arm being-adapted for engagement with the associated drive means and the other end of the lever arm being adapted for engagement by abutment means on the associated drive lever, the arrangement being such that, with the drive lever in its rest position, the abutment means on the drive lever engage the other end of the lever arm to pivot said lever arm whereby the one end thereof disengages the drive means from the ratchet mechanism, and, on movement of the drive lever to a displaced position, the other end of the lever arm disengages from the abutment means and the drive means move into driving engagement with the ratchet mechanism.

Preferably the lever drive means each comprise a fluid-operated piston-cylinder assembly interconnected with the other end of the associated drive lever, extension of the piston of the assembly causing pivotal movement of the associated drive lever about the one end thereof from its rest position towards its fully displaced position.

The fluid supply to said piston-cylinder assemblies is preferably such that, prior to extension of the piston of one assembly to move the associated drive lever from its rest position, the piston of the other assembly is fully retracted to hold the associated drive lever in its rest position.

DESCRIPTION OF PREFERRED EMBODIMENTS

Figure 1:
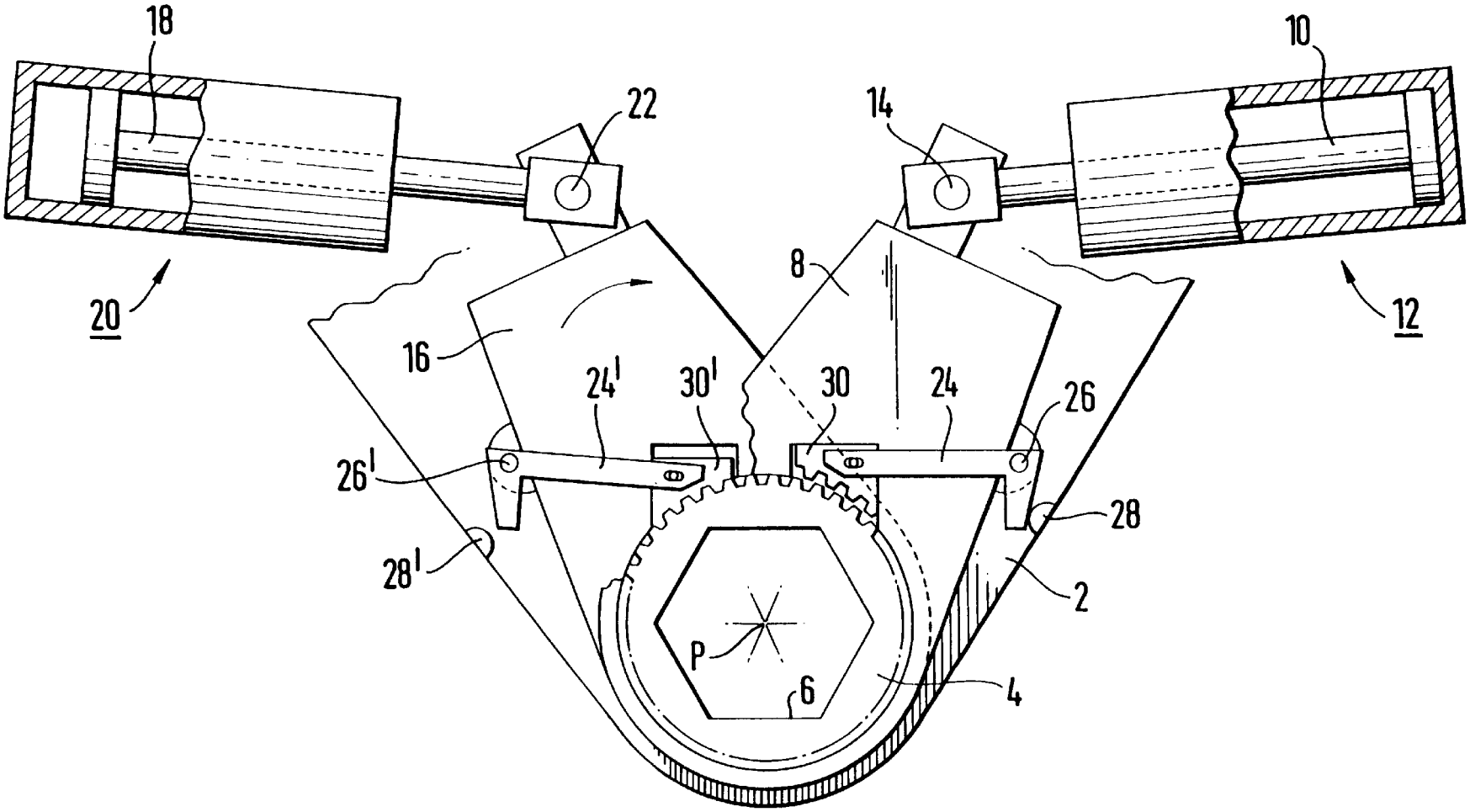
FIGS. 1 and 2 show parts of two alternative torque wrenches according to the invention, while FIG. 1' shows an enlargement of the engagement of the left drive shoe and ratchet mechanism of FIG. 1.
Figure 1:
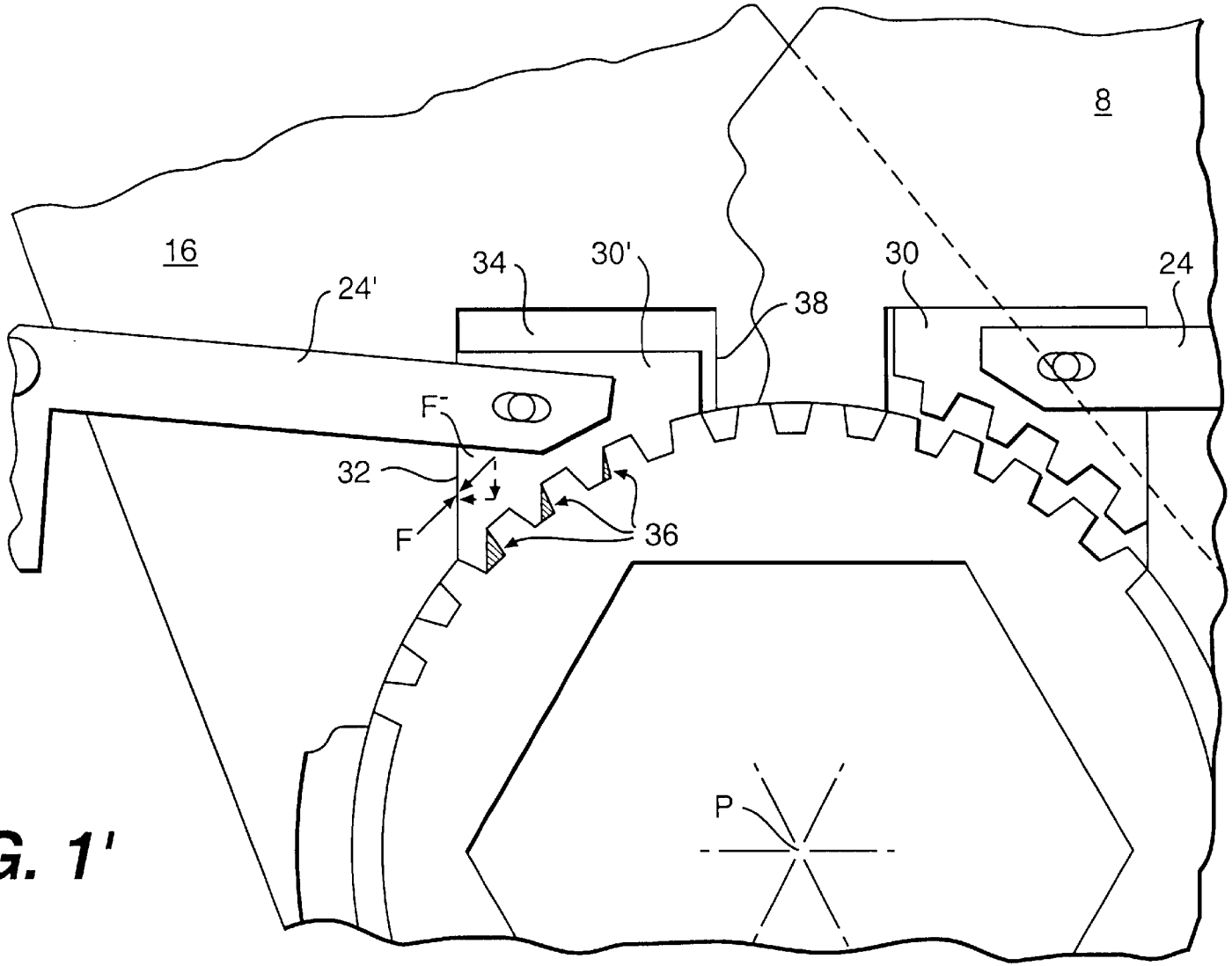

Referring to FIG. 1, there is illustrated part of a bi-directional torque wrench including a housing part of which is shown at 2. The housing 2 contains a ratchet mechanism 4 rotatable within the housing about point P and provided with a hexagonal recess 6 therein for co-operation with a nut, bolt or socket to be rotated.

A first drive lever or crank 8 for the mechanism 4 has one end pivotal about the point P, the piston rod 10 of a first hydraulic piston-cylinder assembly 12 being pivotally attached at 14 to the other end of said lever 8.

The lever 8 is shown in its rest position with the piston rod 10 of the assembly 12 fully retracted. On extension of the rod 10, the lever 8 is pivoted about the point P in an anticlockwise direction towards a fully displaced position as will be detailed below.

A second drive lever or crank 16 for the mechanism 4 has one end pivotal about the point P, the piston rod 18 of a second hydraulic piston-cylinder assembly 20 being pivotally attached at 22 to the other end of the lever 16. The assemblies 12,20 work in opposite directions to one another.

The lever 16 is shown in a displaced position with the piston rod 18 of the assembly 20 partly extended and having pivoted the lever 16 in a clockwise direction from its rest position.

Drive means react between the levers 8,16 and the ratchet mechanism 4 to enable appropriate rotation of said mechanism on pivotal movement of the levers 8,16 about the point P.

More particularly, a carrier arm 24 is pivotally mounted at 26 on the lever 8, one end of said arm 24, with the lever 8 in its illustrated rest position, engaging an abutment 28 within the housing 2 whereby the arm 24 is held in the inoperative position shown in the drawing.

A toothed drive shoe 30 is carried on the other end of said arm 24, said shoe 30, with the arm 24 in its inoperative position, being held out of engagement with the teeth of the ratchet mechanism 4.

The arrangement is such that, on extension of the piston rod 10 of the assembly 12 from its fully retracted position, the lever 8 is pivoted in an anticlockwise direction from its illustrated rest position. The one end of the carrier arm 24 is thereby disengaged from the abutment 28 and pivots in an anticlockwise direction about the point 26 whereby the teeth of the drive shoe 30 are wedged into meshing engagement with the teeth of the ratchet mechanism 4, continued pivotal movement of the lever 8 resulting in corresponding anticlockwise rotation of the mechanism 4.

A corresponding drive arrangement is provided between the lever 16 and the mechanism 4, with components equivalent to those of the arrangement between the lever 8 and the mechanism 4 being similarly referenced but with a dash added.

As the lever 16 is displaced from its rest position, the carrier arm $\mathbf{24}^1$ has disengaged from the abutment $\mathbf{28}^1$ and the drive shoe $\mathbf{30}^1$ has wedged into driving engagement with the ratchet mechanism 4.

As shown in an enlarged scale in FIG. 1', drive shoe 30' experiences a circumferential force F at the initiation of a clockwise movement of crank 16 transmitted by wall 32 of cavity 34, and drive shoe 30' opposes this with a force $F^-$. The components of force $F^-$ include a perpendicular component directed against wall 32 and a parallel component directed parallel to wall 32. The parallel component of force $F^-$ thus serves to push drive shoe 30' into engagement with the teeth of ratchet mechanism 4. Once engaged by the teeth of ratchet mechanism 4, continued clockwise movement of crank 16 causes the teeth of ratchet mechanism 4 to produce another (counter) force acting to push drive shoe 30' out of engagement with the teeth of ratchet mechanism 4. However, as shown by shaded areas 36 of the teeth of drive shoe 30', areas 36 are trapped (relative to the only direction of movement possible for drive shoe 30' which is parallel to wall 32) below the corresponding portion of the meshing teeth of ratchet mechanism 4. Drive shoe 30' is thus trapped or wedged in position during further clockwise movement of crank 16, even though continued movement of crank 16 causes the teeth of ratchet mechanism 4 to react against the teeth of drive shoe 30' with the force acting to move drive shoe 30' out of engagement with the teeth of ratchet mechanism 4. Drive shoe 30' is thus wedged in place so long as crank 16 continues the clockwise movement.

When crank 16 reverses movement, the first (small) initial reverse or counterclockwise movement of crank 16 occurs without engagement of wall 38 and drive shoe 30' due to the gap between drive shoe 30' and wall 38 of cavity 34,. When the reverse movement of crank 16 exceeds the gap distance and thus does cause engagement of wall 38 and drive shoe 30', the gap is now located between drive shoe 30' and wall 32. This gap along wall 32 is sufficient in size to allow areas 36 to clear the corresponding portions of the teeth of ratchet mechanism 4 as drive shoe 30' is constrained to move parallel to wall 32. The escape of the teeth of drive shoe 30' from the teeth of ratchet mechanism is facilitated both by the opposite force direction of the components (forces F and $F^-$ are now oppositely directed or reversed on wall 38, as are the components and particularly the component parallel to wall 38 which now is directed outwards) as well as by the action of the teeth of ratchet mechanism which continue to push the teeth of drive shoe 30' away therefrom (no matter what the direction of rotation of drive shoe 30').

When the counterclockwise movement of crank 16 is completed and a further movement of drive shoe 30' is desired, the first (small) initial clockwise movement crank 16 results in drive shoe 30' being released from the out of engagement position (as shown by drive shoe 30 in FIG. 1) and inwards towards the teeth of ratchet mechanism 4. When the inward clockwise corners of the tips of the teeth of drive shoe 30' first encounter the outward counterclockwise comers of the tips of the teeth of ratchet mechanism 4 (perhaps after the tops of both sets of teeth ride along one another), the downward force component as well as the complementary shapes of the teeth cause the teeth of drive shoe 30' to immediately move into engagement with the teeth of ratchet mechanism 4. Once engagement is achieved, further clockwise movement crank 16 then keeps areas 36 trapped in place to complete the next drive cycle of ratchet mechanism 4.

With both the clockwise and anticlockwise drive arrangements, movement of the piston rod 10,18 to its fully retracted position as the drive shoes 30, 30' ride up and over the teeth of ratchet mechanism 4, brings the one end of the associated lever arm 24,24$^1$ into engagement with the abutment 28,28$^1$ on the housing to pivot said lever arm 24,24$^1$ about the point 26,26$^1$ into its inoperative position and to disengage the drive shoe 30,30$^1$ from the ratchet mechanism 4.

The hydraulic supply to the assemblies 12,20 is such that, on demand to one of said assemblies for extension purposes, the fluid is first of all fed to the other assembly to ensure that the associated piston rod is fully retracted and thereby that the associated drive shoe is disengaged from the ratchet mechanism 4.

So, on driving of the ratchet mechanism 4 in one direction by the shoe 30,30$^1$, the other shoe 30$^1$,30 is totally disengaged from the mechanism, thereby avoiding any locking up of said mechanism.

Figure 2:
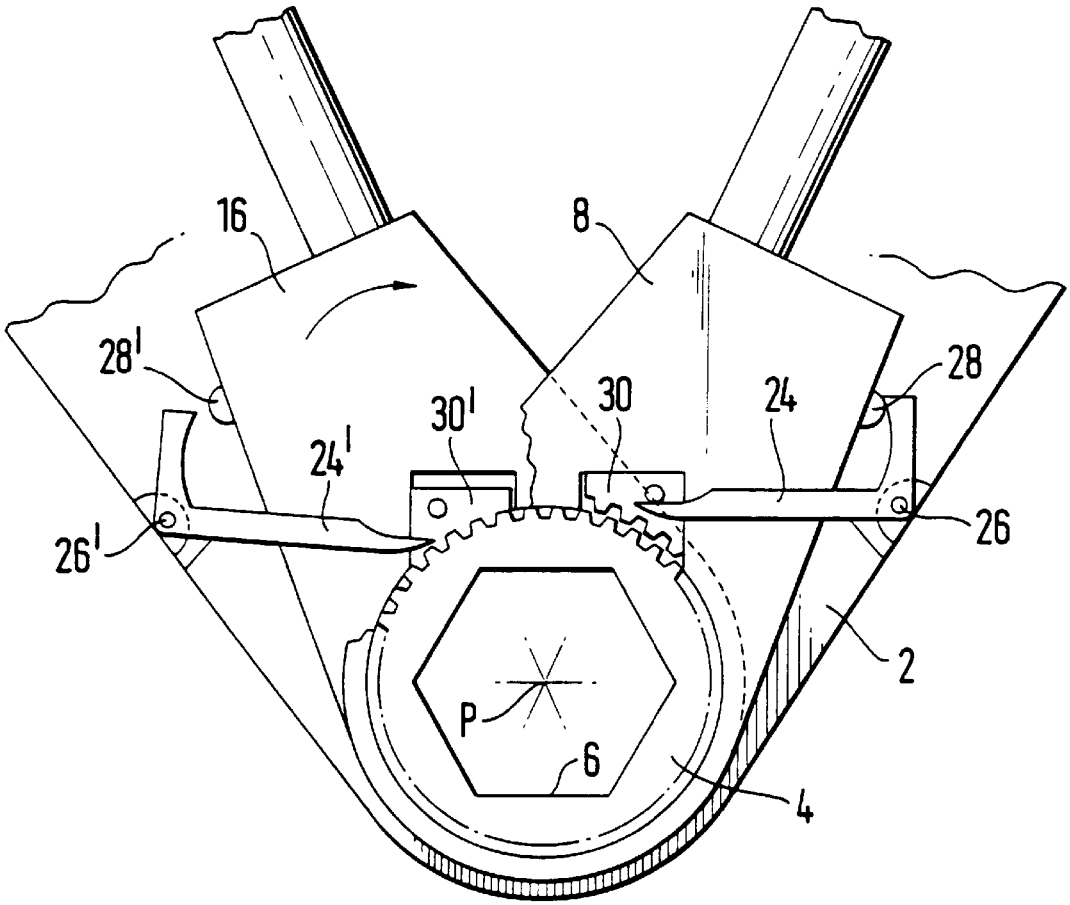

FIG. 2 illustrates an alternative arrangement for engaging and disengaging the drive shoes with and from the ratchet mechanism. Components equivalent to those of FIG. 1 are similarly referenced.

Effectively, the locations of the lever arms 24,24$^1$ are pivotally mounted on the housing 2. With the lever 8,16 in its rest position, the one end of the lever arm 24,24$^1$ engages the associated abutment 28,28$^1$ whereby the other end of the lever arm 24,24$^1$ is pivoted upwardly to engage the drive shoe 30,30$^1$ and lift it out of engagement with the ratchet mechanism 4 (as shown for shoe 30 in FIG. 2).

Pivoting movement of the lever 8,16 from its rest position towards a displaced position results in disengagement of the one end of the lever arm 24,24$^1$ from the abutment 28,28$^1$ and downward pivoting movement of the other end of the lever arm 24,24$^1$ out of contact with the drive shoe 30,30$^1$ whereby said shoe 30,30$^1$ moves into meshing engagement with the ratchet mechanism 4 (as is shown for shoe 30$^1$ in FIG. 2).

Thus there is provided a bi-directional torque wrench which is particularly suited to remote operation, for example in subsea and nuclear applications, in that there is no need to provide separate switching of the drive means when moving from clockwise to anticlockwise rotation and vice versa. Location of a drive lever 8,16 in its rest position ensures that the associated drive shoe is totally disengaged from the ratchet mechanism, and thereby enables rotation of the mechanism 4 by the other drive lever 16,8 without the possibility of malfunctioning of the wrench.

Clearly the precise means by which a drive shoe is disengaged from the ratchet mechanism 4 can vary from those illustrated, providing said disengagement is achieved when the lever is in its rest position.

I claim:

1. A torque wrench comprising a housing (2) in which is mounted a rotatable ratchet mechanism (4) adapted to co-operate with a component to be rotated by the wrench, a first drive lever (8) extending radially of said ratchet mechanism and pivotal about one end thereof coaxial with the ratchet mechanism (4), first lever drive means (12) for applying a driving force to the other end of the first lever (8) to pivot said first lever (8) about the one end thereof reciprocatingly between a rest position and a fully displaced position, first drive means (30) reacting between the first lever (8) and the ratchet mechanism (4) whereby, on movement of the first lever (8) from the rest position towards the fully displaced position, the ratchet mechanism (4) is rotated in one direction, a second drive lever (16) extending radially of said ratchet mechanism (4) and pivotal about one end thereof coaxial with the ratchet mechanism (4), second lever drive means (20) for applying a driving force to the other end of the second lever (16) to pivot said second lever (16) about the one end thereof reciprocatingly between a rest position and a fully displaced position, and second drive means (30$^1$) reacting between the second lever (16) and the ratchet mechanism (4) whereby, on movement of the second lever (16) from the rest position towards the fully displaced position, the ratchet mechanism (4) is rotated in the other direction, characterised by a control means (24, 26, 28; 24$^1$, 26$^1$, 28$^1$) for controlling an interaction between the housing (2) and the first and second drive means (30, 30$^1$) such that, with a lever (8, 16) in its rest position, the associated drive means (30, 30$^1$) is disengaged from the ratchet mechanism (4), and such that, on movement of a drive lever (8, 16) from its rest position towards its fully displaced position, the associated drive means (30, 30$^1$) is brought into engagement with the ratchet mechanism (4) while the other drive lever (16,8) is held in its rest position with its associated drive means (30$^1$, 30) disengaged from the ratchet mechanism (4).

2. A torque wrench as claimed in claim 1 in which each drive means (30, 30$^1$) is mounted on a lever arm (24, 24$^1$) pivotal on the associated drive lever (8, 16), an abutment means (28, 28$^1$) being providing on the housing (2) (a) for engaging, with the drive lever (8, 16) in its rest position, the arm lever (24, 24$^1$) with the associated abutment means (28, 28$^1$) to pivot the drive means (30, 30$^1$) out of engagement with the ratchet mechanism (4), and, (b) for disengaging on movement of the drive lever (8, 16) to a displaced position, the lever arm (24, 24$^1$) from said abutment means (28, 28$^1$) whereby the drive means (30, 30$^1$) move into driving engagement with the ratchet mechanism (4).

3. A torque wrench as claimed in claim 1 and including, for each drive lever (8, 16), a lever arm (24, 24$^1$) pivotal on the housing (2), one end of the lever arm (24, 24$^1$) being adapted for engagement with the associated drive means (30, 30$^1$) and the other end of the lever arm (24, 24$^1$) being adapted for engagement by an abutment means (28, 28$^1$) on the associated drive lever (8, 16) for, with the drive lever (8, 16) in its rest position, engaging the other end of the lever arm (24, 24$^1$) to pivot said lever arm (24, 24$^1$) whereby the one end thereof disengages the drive means (30, 30$^1$) from the ratchet mechanism (4), and, on movement of the drive lever (8, 16) to a displaced position, the other end of the lever arm (24, 24$^1$) disengages from the abutment means (28, 28$^1$) and the drive means (30, 30$^1$) move into driving engagement with the ratchet mechanism (4).

4. A torque wrench as claimed in claim 1 in which the lever drive means each comprise a fluid-operated piston-cylinder assembly (12, 20) interconnected with the other end of the associated drive lever (8, 16), extension of the piston (10, 18) of the assembly (12, 20) causing pivotal movement of the associated drive lever (8, 16) about the one end thereof from its rest position towards its fully displaced position.

5. A torque wrench as claimed in claim 4 in which the fluid supply to the piston-cylinder assemblies (12, 20) is such that, prior to the extension of the piston (10, 18) of one assembly (12, 20) to move the associated drive lever (8, 16) from its rest position, the piston (18, 10) of the other assembly (20, 12) is fully retracted to hold the associated drive lever (16, 8) in its rest position.

* * * * *